United States Patent [19]

Camp

[11] 4,339,288

[45] Jul. 13, 1982

[54] GAS GENERATING COMPOSITION

[75] Inventor: Albert T. Camp, Welcome, Md.

[73] Assignee: Peter Stang, Port Tobacco, Md.

[21] Appl. No.: 135,634

[22] Filed: Mar. 31, 1980

Related U.S. Application Data

[63] Continuation of Ser. No. 906,596, May 16, 1978, abandoned.

[51] Int. Cl.[3] ..... C06B 45/34

[52] U.S. Cl. ..... 149/8; 149/35

[58] Field of Search ..... 149/35, 8, 19.8

[56] References Cited

U.S. PATENT DOCUMENTS

| | | | |
|---|---|---|---|
| 2,981,616 | 4/1961 | Boyer | 149/35 |
| 3,459,607 | 8/1969 | Paustian et al. | 149/8 |
| 3,741,585 | 6/1973 | Hendrickson et al. | 149/35 |
| 3,779,823 | 12/1973 | Price et al. | 149/35 |
| 3,794,535 | 2/1974 | Bertrand et al. | 149/8 |
| 3,855,022 | 12/1974 | Flynn | 149/8 |
| 3,878,003 | 4/1975 | LoPresti et al. | 149/19.8 |
| 4,002,514 | 1/1977 | Plomer et al. | 149/19.8 |

OTHER PUBLICATIONS

Reese, *Chem. & Eng. News,* Oct. 23, 1978, p. 70 and Nov. 20, 1978, p. 48.

*Phoenix Quarterly,* 10 (#2), pp. 2–3 (Summer 1978).

*Primary Examiner*—Edward A. Miller

*Attorney, Agent, or Firm*—Stevens, Davis, Miller & Mosher

[57] ABSTRACT

An improved gas generating composition for generating nitrogen gas made by coating pellets of a pyrotechnic alkali metal azide composition with an energetic lacquer coating.

15 Claims, No Drawings

GAS GENERATING COMPOSITION

This invention may be used by the Government of the United States of America for non-commercial governmental purposes without payment to the inventors or their assignees.

This is a continuation of application Ser. No. 906,596, filed May 16, 1978, and now abandoned.

BACKGROUND OF THE INVENTION

This invention pertains to improved gas generating compositions and more specifically to compositions which produce nitrogen as the predominant gaseous product. While this invention has broad utility, a major use would be for inflating emergency safety devices such as automobile passive restraint systems—namely air bags, aircraft safety chutes and other passenger safety devices.

Because of its inertness, nitrogen is well suited as a gas for inflating emergency safety devices. The nitrogen gas employed in such devices is usually supplied by the chemical reaction of a nitrogen gas generating composition. Since emergency inflating devices must often be extremely compact, low cost and lightweight, a pyrotechnic chemical composition is often used to generate the nitrogen gas. A convenient chemical source of pure nitrogen is sodium azide. Although this well known substance can be made to release nitrogen if heated to about 750° F. (400° C.), the process is greatly facilitated by the incorporation of oxidants, such as certain metal oxides or inorganic salts.

Other alkali metal azides, such as potassium azide and lithium azide, can also be made to release nitrogen; however, they are more expensive than sodium azide and possess properties which make them less desirable than sodium azide as nitrogen gas generants. At the present time, sodium azide is the preferred source of nitrogen for emergency safety devices such as the widely publicized and debated air bags for automobiles. However, sodium azide presents some extremely serious problems in widespread commercial applications. Sodium azide is extremely toxic if inhaled or ingested by humans or other animals, a property shared with all water-soluble azides. Further, an aqueous solution of sodium azide will react with metal ions of copper, lead and many other metals to produce highly sensitive explosives. Lead azide, for example, is a well known and sensitive primary explosive while copper azide is deemed far too sensitive to shock, friction, and heat to be of practical use. Sodium azide also reacts with common acids, such as battery acids, to produce hydrazoic acid, a gas with lethality comparable to that of hydrogen cyanide used in gas chambers for execution. Thus, while sodium azide is an effective source of nitrogen for emergency safety devices, it is an extremely dangerous one. Indeed, even after sodium azide has been oxidized in generating nitrogen, danger remains, since the resulting sodium oxide is a well-known caustic.

Since the azides used in gas generating systems such as those for automobile air bags might come in contact with water or battery acid after an accident, during servicing, in junkyards after useful life, or otherwise, it is important that the essential dangers of exposed azides and by-products be minimized insofar as possible.

SUMMARY OF THE INVENTION

The present invention combines the good features of sodium azide, such as reasonable cost and efficiency, with those of another material which by itself would have other serious deficiencies in commercial gas generating applications, but which in special combination with sodium azide produces a highly unexpected effect. This material is a waterproof, acid-resistant lacquer based on stabilized cellulose nitrate (nitrocellulose) and an energetic plasticizer. This lacquer is a double-base propellant of the type which may itself be used as a gas generant. However, the gases it generates include carbon monoxide, hydrogen and steam, the first two of which are very objectionable if released inside vehicles in amounts larger than a few parts per thousand. When employed as a coating for pellets composed of sodium azide and a suitable oxidant, however, it serves to strongly bond the pellets into a charge which repels water and acid, is non-dusting and thermally stable at temperatures of over 200° F. The coated pellets are low in toxicity, both prior to and after combustion. Prior to combustion, of course, the lacquer coating prevents exposure of the dangerous sodium azide. On combustion of the charge, nitrogen is the predominant product and the small amounts of hydrogen and carbon monoxide evolved from the coating are oxidized to carbon dioxide and water by the oxidant employed in the pellets. The carbon dioxide and water react with the sodium oxide produced to form harmless washing soda, i.e., sodium carbonate. Thus, all the harmful combustion products are rendered harmless.

DESCRIPTION OF THE PREFERRED EMBODIMENTS

In the present invention, sodium azide, potassium azide or lithium azide is mixed with one or more of the inorganic salts and metal oxides known to facilitate the release of nitrogen from alkali metal azides, such as potassium perchlorate, strontium nitrate, chromium trichloride, ammonium perchlorate, chromic chloride, ferric chloride, cobaltic chloride, cupric oxide, ferric oxide and molybdic oxide. Calcium carbonate or magnesium carbonate may be used as a coolant if necessary. The mixture is preferably pelletized. Pelletizing may be accomplished by means of a pelletizing press or by any other suitable method. The pellets are then coated with a lacquer of stabilized cellulose nitrate (nitrocellulose) and an energetic plasticizer.

The nitrocellulose preferably possesses a nitrogen content of 12.6% by weight of the nitrocellulose on a dry basis and a preferably 5 to 20 second viscosity (measured as a 10% solution in acetone and ethanol by the well-known falling ball or Hercules method). Nitrocellulose having a different nitrogen content and viscosity may also be used. Nitrocellulose containing from 10.0 to 13.4% nitrogen by weight on a dry basis is commercially available and is suitable. Nitrocellulose having a viscosity of $\frac{1}{4}$ to 100 seconds may be used, consistent with the objective of achieving an appropriately thin coating of the dried lacquer on the azide pellets.

The energetic plasticizer is a nitrate ester plasticizer, such as 1,1,1-trimethylol ethane trinitrate, diethylene glycol dinitrate, triethylene glycol dinitrate, and pentaerythritol trinitrate, or a mixture of two or more of these to achieve desired properties. The preferred nitrate ester plasticizer is 1,1,1-trimethylol ethane trinitrate because of its combination of low volatility, high energy, safety, and ease of manufacture.

The lacquer is prepared by dissolving together the nitrocellulose and nitrate ester plasticizer. Suitable solvents include low boiling ketones, alcohols, acetate esters and toluene. A preferred solvent is methylethyl ketone. Certain additives may be incorporated in the lacquer solution. For example, the cellulose nitrate and nitrate ester plasticizers are preferably stabilized against temperature decomposition by one or more conventional stabilizers such as symmetrical diethyl diphenyl urea, 2-nitrodiphenyl amine, diphenyl amine, resorcinol, N-methyl-paranitroaniline and other N-alkyl-paranitroanilines. In addition, low temperature plasticizers may be added in addition to the nitrate ester plasticizers to prevent brittleness at very low temperatures. Such low temperature plasticizers include dipropyl adipate, diethyl phthalate, dibutyl phthalate, dimethyl azelate, diethyl azelate, dimethyl sebacate, diethyl sebacate, diallyl phthalate, allyl diglycol carbonate, diethylene glycol dinitrate, triethylene glycol dinitrate, di-n-propyl adipate and related plasticizers. Since it is essential that the dried lacquer ignite and burn during the gas generating reaction, ignition and combustion aids may be added to the lacquer composition. Such ignition and combustion aids include: monobasic cupric beta-resorcylate, monobasic cupric salicylate, and the cupric chelate of 2,4 dihydroxy benzophenone. The preferred ignition and combustion aid is monobasic cupric beta-resorcylate.

Once the lacquer solution is made up, the azide-oxidant pellets are coated with it by any one of the several methods known to the art, and then left to dry.

The alkali metal azide may comprise from 50 to 90% of the weight of the coated pellets, when dried. The oxidant may comprise from 9 to 48% of the weight of the dried pellets and may consist of a combination of oxidants totaling from 8 to 48% of the weight of the dried pellets. Coated pellets having these ranges can be made from commercially available sodium azide-oxidant pellets. It is expected that amounts of azide and oxidant may very even more widely and still result in operable gas generating pellets.

The lacquer after coating and drying may comprise from 2 to 42% by weight of the dried pellets. As to the composition of the dried lacquer itself, the nitrocellulose may range from 25 to 99% of the weight of the dried lacquer, but is preferably 40 to 70% by weight thereof. The nitrate ester plasticizer may comprise up to 75% by weight of the dried lacquer but preferably 30 to 60% of the dried lacquer by weight. The amount of stabilizer added may comprise up to 4% of the dried lacquer by weight. If a low temperature plasticizer is employed in the lacquer it may comprise up to 5% of the dried lacquer by weight. If an ignition and combustion aid for the dried lacquer coating is employed, it may comprise from 0.5 to 3.0% of the weight of the dried lacquer. Of course, the incorporation of additives will result in a proportionate decrease in the amounts of nitrocellulose and nitrate ester plasticizer employed.

As prepared above, the aforementioned pellets of precombined alkali metal azide and oxidants are sufficiently coated with lacquer to render them substantially waterproof under normal exposure to the elements. They are highly resistant to common acids at normally encountered temperatures, thus further reducing the likelihood of forming deadly hydrazoic acid in the event of contamination of the pellets. Thus, the invention maintains the integrity of the pellets, waterproofs them and enhances their ignitibility and combustibility to form the desired nitrogen gas. In other words, it helps to assure that the generant works only as intended. A further advantage of the invention is the utility of the lacquer as an adhesive for structuring and assembling of the pellets into charges and for maintaining the structure against the vibration and mild shocks characteristic of the everyday operation of passenger vehicles. On the other hand, the pellets may be dried separately, so that they do not adhere to one another. In this manner, free-flowing pellets rather than a structured mass of lacquer-coated pellets may be obtained.

As mentioned above, the combustion products of the dried lacquer coating on the pellets are a small amount of carbon dioxide and steam which react with the caustic by-product of the alkali metal azide decomposition to render it less hazardous. In the case of sodium azide, the solid residue from its decomposition, which is sodium oxide, reacts with the carbon dioxide and steam to produce washing soda, i.e., sodium carbonate, a relatively harmless product. To assure a complete combustion of the dried lacquer coating to carbon dioxide and steam, only a modest increase in oxidant is necessary beyond that required for the production of nitrogen from the alkali metal azide. This additional oxidant is easily computed and may be added, if necessary, to azide-oxidant pellets which have been previously prepared. The formulation of the nitrogen gas generating composition can be altered to produce additional carbon dioxide and water in excess of that which would be readily absorbed by the sodium oxide. This could be achieved by increasing the amount of the dried lacquer coating in relation to the alkali metal azide/oxidant mixture and increasing the oxidant amount, if necessary. However, for the auto safety bag and aircraft safety chute inflation applications, a maximum content of pure nitrogen is preferable to a mixture of gases, and, therefore, the relative amount of the dried lacquer coating is adjusted accordingly.

The following examples will serve to illustrate the invention but are not intended to limit its broad application and capability of variation.

EXAMPLE I 200 grams of pellets, consisting of well-blended sodium azide, 70% by weight, and potassium perchlorate, 30% by weight, and sized to a 0.2 inch diameter and length are carefully mixed in a conductive polyethylene container with 50 grams of a lacquer solution, the weight ratio of lacquer to solvent being 32:68. The lacquer portion is 34% nitrocellulose (dry weight basis) having 12.6% nitrogen content and 12 seconds viscosity, 64% by weight, 1,1,1-trimethylol ethane trinitrate, 1% by weight symmetrical diethyl diphenyl urea stabilizer, and 1% by weight monobasic cupric beta-resorcylate of about 3 micron average diameter. The solvent comprises ethanol, toluene, and methylethyl ketone in a weight ratio of 7:9:84. The lacquer solution is prepared by first dispersing the monobasic cupric beta-resorcylate in the 1,1,1-trimethylol ethane trinitrate containing the symmetrical diethyl diphenyl urea, followed by dispersing the nitrocellulose (already desensitized with the ethanol) in the 1,1,1-trimethylol ethane trinitrate. Toluene is added to the composition obtained and finally the active solvent, methylethyl ketone, is added. The lacquer is slowly formed by the dissolution of the nitrocellulose, a process typically requiring several hours of gentle mixing in a closed container.

Mixing of the lacquer solution with the pellets is accomplished gently with a rubber spatula to ensure uniform coating of the pellets without damaging them. Some of the solvent is allowed to evaporate until the mass is somewhat sticky. The entire mass is then packed into a polyethylene coated screen basket of appropriate size to give a cylinder of approximately 3 inches diameter and 1 inch thickness. The assembly is allowed to dry for one day under a laboratory hood at room temperature and then dried in a circulating air oven at 60° C. for one day to substantially constant weight. The resulting dried assembly is strong and rigid but not brittle and may be dropped 2 feet onto a wooden surface without damage. A sample of the dried lacquer coating forms a film comparable in toughness to photographic film, but more pliable because of the high proportion of high energy nitrate plasticizer used.

To test for waterproofness the dried assembly of coated pellets is immersed in water at 140° F. under a chemical hood for one week and the water then analyzed for salt substances. Analysis shows no dissolved sodium azide or potassium perchlorate or other ingredients of the assembly, indicating complete waterproofness.

The assembly is then immersed for a week in 50% sulfuric acid at 100° F., the whole container placed in a jar which is vented to an analytical device to measure volume and nature of evolved gases. No hydrazoic acid or other toxic gas is evolved during this seven day exposure, further indicating waterproofness and resistance of the coated pellet assembly to acids.

EXAMPLE II 200 grams of pellets of 0.2 inch diameter and length consisting of 58.2% by weight of sodium azide and 41.8% by weight of potassium perchlorate are gently mixed in a conductive polyethylene beaker (using a rubber spatula to avoid breakup of the pellets) with a viscous lacquer composed, on a solvent-free basis, of 45.0% by weight nitrocellulose of 12.6% nitrogen content and 5-second viscosity (determined as a 10% solution in acetone and ethanol by the well-known falling ball method), 53.0% by weight 1,1,1-trimethylol ethane trinitrate, 1.0% by weight symmetrical diethyl diphenyl urea and 1.0% by weight monobasic cupric beta-resorcylate of approximately 3 micron average particle diameter. The lacquer is prepared by mixing the cupric beta-resorcylate with the 1,1,1-trimethylol ethane trinitrate and the symmetrical diethyl diphenyl urea, adding toluene to disperse the mixture, then adding the nitrocellulose (desensitized with ethanol) and finally adding methylethyl ketone. The complete makeup of the lacquer composition is 45 grams of nitrocellulose (on a dry weight basis) 53 grams 1,1,1-trimethylol ethane trinitrate, 1 gram of symmetrical diethyl diphenyl urea, 1 gram of monobasic cupric beta-resorcylate, 20 grams of 95% ethanol, 30 grams of toluene and 200 grams of methylethyl ketone.

After thorough mixing with the lacquer composition, the coated pellets are packed into a polyethylene cup in which 1/16 inch diameter holes are previously drilled on centers approximately ¼ inch apart for the purpose of assisting in the evaporation of solvents from the lacquer coating. The internal dimensions of the cup are 3 inches diameter and 3 inches depth. The cup, filled to a depth of about 1.5 inches with the lacquered pellets, is placed on a wire rack in a forced air laboratory hooded room temperature for 24 hours and then a forced air oven at 60° C. for complete drying to constant weight. The assembly of pellets and dried lacquer is easily removed from the plastic cup. When ignited this charge produces a gas composition of approximately 85 mole percent nitrogen, 10 mole percent carbon dioxide, and 5 mole percent water vapor.

EXAMPLE III 20 pounds of compressed pellets composed of uniformly blended sodium azide 70% by weight and potassium perchlorate 30% by weight and with dimensions of 0.25 inch diameter and 0.13 inch length are coated uniformly, by the so-called Wurster fluid-bed process, with a lacquer of the following composition: 34% (dry weight basis) of nitrocellulose of 12.6% nitrogen content and 12-second viscosity (measured as a 10% solution in 90:10 acetone alcohol by the well-known falling ball method of Hercules, Inc., 64% by weight 1,1,1-trimethylol ethane trinitrate, 1% symmetrical diethyl diphenyl urea stabilizer, and 1% monobasic cupric beta-resorcylate of about 3 micron average diameter. As prepared, the solvent for the lacquer constitutes 80% of the total lacquer solution by weight and comprises ethanol, toluene, and methylethyl ketone in a weight ratio of 7:9:84. The lacquer is prepared as in Example I except for the differences in ratio of total volatile solvents to total active ingredients of the dried lacquer film. Sufficient lacquer (5 pounds) is used to provide a 5% added coating (dry basis) by weight of the original pellets after thorough drying.

In the Wurster process, described in the Journal of the American Pharmaceutical Association, Vol. 48, p. 451–454, the pellets are suspended in an air stream while being spray-coated with lacquer. Because of the special design of the Wurster apparatus, the pellets become uniformly coated with lacquer and are dried to a tack-free condition while suspended in moving, warm air. Thus, they do not adhere to one another. This process is preferred when it is desired to have free-flowing pellets rather than a structured mass of lacquer-coated pellets, or when it is desired to minimize the percent of coating required. Otherwise, the advantages of the coating are the same as those previously described and illustrated by Examples I and II.

The pellets are given a final drying treatment in a screened tray at 140° F. temperature in a circulating air oven for 24 hours. Samples are then subjected to the same tests as described in Example I to successfully establish uniformity and chemical resistance of the coating.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A gas generating composition for use in inflating automobile crash bags comprising a mixture, in pellet form, of an alkali metal azide and an oxidant, each pellet coated with a lacquer comprising stabilized cellulose nitrate and at least one nitrate ester plasticizer.

2. The gas generating composition of claim 1, wherein the nitrogen content of said stabilized cellulose nitrate is from 10.0 to 13.4% on a dry weight basis, and said nitrate ester plasticizers are selected from the group consisting of 1,1,1-trimethylol ethane trinitrate, diethylene glycol dinitrate, triethylene glycol dinitrate, and pentaerythritol trinitrate.

3. The gas generating composition of claim 1, wherein the nitrogen content of said stabilized cellulose nitrate is 12.6% on a dry weight basis and the said nitrate ester plasticizer is 1,1,1-trimethylol ethane trinitrate.

4. The gas generating composition of claim 1 wherein said alkali metal azide is selected from the group consisting of sodium azide, potassium azide and lithium azide or mixtures thereof and wherein said oxidant is selected from the group consisting of potassium perchlorate, strontium nitrate, ammonium perchlorate, chromic chloride, ferric chloride, cobaltic chloride, cupric oxide, ferric oxide, molybdic oxide, or mixtures thereof.

5. The gas generating composition of claim 2 wherein said alkali metal azide is selected from the group consisting of sodium azide, potassium azide and lithium azide or mixtures thereof and wherein said oxidant is selected from the group consisting of potassium perchlorate, strontium nitrate, ammonium perchlorate, chromic chloride, ferric chloride, cobaltic chloride, cupric oxide, ferric oxide, molybdic oxide, or mixtures thereof.

6. The gas generating composition of claim 3 wherein said alkali metal azide is selected from the group consisting of sodium azide, potassium azide and lithium azide or mixtures thereof and wherein said oxidant is selected from the group consisting of potassium perchlorate, strontium nitrate, ammonium perchlorate, chromic chloride, ferric chloride, cobaltic chloride, cupric oxide, ferric oxide, molybdic oxide, or mixtures thereof.

7. The gas generating composition of claim 1 wherein said alkali metal azide is sodium azide and said oxidant is potassium perchlorate.

8. The gas generating composition of claim 2 wherein said alkali metal azide is sodium azide and said oxidant is potassium perchlorate.

9. The gas generating composition of claim 3 wherein said alkali metal azide is sodium azide and said oxidant is potassium perchlorate.

10. The gas generating composition of claim 1 wherein the alkali metal azide comprises about 50 to 90%, the oxidant comprises about 8 to 48%, and the dried lacquer about 2 to 42% by weight of the composition.

11. The gas generating composition of claim 10, wherein the cellulose nitrate comprises about 25 to 99% by weight of the dried lacquer, and the nitrate ester plasticizer comprises up to 75% by weight of the dried lacquer.

12. The gas generating composition of claim 11, wherein the cellulose nitrate comprises about 40 to 70% by weight of the dried lacquer, and the nitrate ester plasticizer comprises about 30 to 60% by weight of the dried lacquer.

13. The gas generating composition of claim 1 wherein said lacquer is water and acid resistant.

14. A gas generating composition for use in inflating automobile crash bags, about 93% by weight of said composition consisting essentially of a 70:30 mixture by weight of sodium azide and potassium perchlorate, said mixture being in pellet form, and about 7% by weight of said composition being a lacquer coating of each pellet, said lacquer consisting essentially of about 34% dry weight basis nitrocellulose having 12.6% nitrogen content, about 64% by weight of 1,1,1-trimethylol ethane trinitrate, about 1% by weight symmetrical diethyl diphenyl urea and about 1% by weight monobasic cupric beta-resorcylate.

15. A gas generating composition for use in inflating automobile crash bags, about 95% by weight of said composition consisting essentially of a 58:42 mixture by weight of sodium azide and potassium perchlorate, said mixture being in pellet form, and about 5% by weight of said composition being a lacquer coating of each pellet, said lacquer consisting essentially of about 45% dry weight basis nitrocellulose having 12.6% nitrogen content, about 53% by weight 1,1,1-trimethylol ethane trinitrate, about 1% by weight symmetrical diethyl diphenyl urea and about 1% by weight monobasic cupric beta-resorcylate.

* * * * *